US005212843A

United States Patent [19]

Kamata

[11] Patent Number: 5,212,843

[45] Date of Patent: May 25, 1993

[54] HELMET

[75] Inventor: Eitaro Kamata, Tokyo, Japan

[73] Assignee: Shoei Kako Kabushiki Kaisha, Tokyo, Japan

[21] Appl. No.: 16,437

[22] Filed: Feb. 19, 1987

[30] Foreign Application Priority Data

Dec. 17, 1986 [JP] Japan ..... 61-300583

[51] Int. Cl.[5] ..... A42B 3/02

[52] U.S. Cl. ..... 2/424; 2/171.3

[58] Field of Search ..... 2/424, 425, 410, 184.5, 2/171.3, 6

[56] References Cited

U.S. PATENT DOCUMENTS

| | | | |
|---|---|---|---|
| 4,081,865 | 4/1978 | Bergee et al. | 2/425 |
| 4,115,874 | 8/1978 | Hasegawa | 2/425 X |
| 4,498,202 | 2/1985 | Yamamoto | 2/424 |
| 4,538,303 | 9/1985 | Schnitzler | 2/424 |
| 4,586,200 | 5/1986 | Poon | 2/424 X |
| 4,598,430 | 7/1986 | Nava | 2/424 X |
| 4,612,675 | 9/1986 | Broersma | 2/424 |
| 4,697,289 | 10/1987 | Nava | 2/424 X |
| 4,698,856 | 10/1987 | Arai | 2/425 |
| 4,704,746 | 11/1987 | Nava | 2/424 |
| 5,058,212 | 10/1991 | Kamata | 2/424 |
| 5,088,129 | 2/1992 | Kamata | 2/424 X |
| 5,093,938 | 3/1992 | Kamata | 2/424 |

FOREIGN PATENT DOCUMENTS

| | | | |
|---|---|---|---|
| 0081210A2 | 6/1983 | European Pat. Off. . | |
| 0081210A3 | 4/1985 | European Pat. Off. . | |
| 7628170 | 12/1976 | Fed. Rep. of Germany . | |
| 3214020A1 | 7/1983 | Fed. Rep. of Germany . | |
| 3304652A1 | 9/1983 | Fed. Rep. of Germany . | |
| 3332577A1 | 3/1985 | Fed. Rep. of Germany . | |
| 3419302 | 11/1985 | Fed. Rep. of Germany | 2/425 |
| 3617745A1 | 11/1986 | Fed. Rep. of Germany . | |
| 3705003A1 | 6/1988 | Fed. Rep. of Germany . | |
| 2353240 | 12/1977 | France . | |
| 2525441 | 10/1983 | France . | |
| 475803 | 12/1937 | United Kingdom . | |
| 2007493A | 5/1979 | United Kingdom . | |
| 2134774A | 8/1984 | United Kingdom . | |
| 2167285A | 5/1986 | United Kingdom . | |
| 2184640 | 7/1987 | United Kingdom | 2/424 |

*Primary Examiner*—Peter Nerbun

*Attorney, Agent, or Firm*—Armstrong, Westerman, Hattori, McLeland & Naughton

[57] ABSTRACT

A helmet includes a cap body which is provided with a chin cover portion defining the lower edge of a window opening formed on the front surface of the cap body and a shield plate on the cap body for closing the window opening. The helmet is formed so that a shell of the cap body is divided at a position of the chin cover portion into an upper shell portion and a lower shell portion which are superposed and connected with each other with the lower shell portion positioned on the outer side of the upper shell portion, a distribution chamber communicating with the interior of the cap body through a plurality of jet ports is defined between the upper shell portion and the lower shell portion at the chin cover portion, and an air introducing port in communication with the distribution chamber and opening to the front surface of the chin cover portion is provided in the lower shell portion. The jet ports consist of two groups of which one opens to the rear surface of the chin cover portion and the other to the lower surface of the window opening.

10 Claims, 10 Drawing Sheets

HELMET

BACKGROUND OF THE INVENTION

1. Field of the Invention

The present invention principally relates to helmets of a type used by an operator of a motorcycle or a racing car, and particularly to an improvement in a helmet in which a cap body is provided with a chin cover portion extending so as to define the lower edge of a window opening in a front surface of the cap body, and a shield plate is provided on the cap body to close the window opening.

2. Description of the Prior Art

There has conventionally been known a helmet designed so that in order to prevent a wearer's breath from staying inside its cap body, air introducing holes are made in the chin cover portion of the cap body so as to introduce into the interior of the cap body a travelling wind generated as the result of travelling of a vehicle operated by the wearer.

However, in the construction of the conventional helmet, even if an attempt is made to form larger air introducing holes in order to effectively introduce the travelling wind inside the chin cover portion, there is a certain limitation for the reason of strength of the chin cover portion.

Furthermore, the wearer's breath cannot be promptly discharged outside the cap body, and a blur sometimes occurs on the inner surface of the shield plate.

SUMMARY OF THE INVENTION

The present invention has been achieved in view of the foregoing, and it is an object of the invention to provide a helmet of the aforesaid type which is constructed to effectively introduce the travelling wind into the chin cover portion without impairing the strength of the chin cover portion and can promptly discharge the wearer's breath outside the cap body.

For achieving the above-described object, according to a first aspect of the present invention, there is provided a helmet comprising a cap body which has a shell divided into an upper shell portion and a lower shell portion at a position of a chin cover portion, these shell portions being superposed and connected with each other with the lower shell portion positioned on the outer side of the upper portion a distribution chamber communicating with the interior of the cap body through a plurality of jet ports is defined between the upper shell portion and the lower shell portion at the chin cover portion, and an air introducing port in communication with the distribution chamber and opening to the front surface of the chin cover portion is provided in the lower shell portion.

With the above-described construction, the travelling wind introduced from the air introducing port into the distribution chamber can be positively supplied into a predetermined position within the cap body and effectively remove a hot air staying inside the cap body, and the distribution chamber and air introducing port can be formed in the shell easily without significantly impairing the strength thereof.

In addition to the aforementioned structure, if an exhaust port is provided to have an outside opening in the upper shell portion and the opening is covered by the lower shell portion leaving a vent gap therebetween, the lower shell portion can be utilized as a cover for the discharge port to preclude entry of rain or the like into the discharge port while allowing the discharge of air therefrom. Accordingly, a cover for exclusive use with the port need not be provided, thus enabling a helmet to be produced at less cost.

Furthermore, according to a second aspect of the present invention, there is provided a helmet having a chin cover portion in which are provided a laterally extending distribution chamber, an air introducing port communicating with said distribution chamber and opening to the front surface of the chin cover portion, a plurality of first jet ports communicating with the distribution chamber and opening to the rear surface of the chin cover portion and a plurality of second jet ports communicating with the distribution chamber and opening to the lower surface of a window opening.

Owing to the above-described structure, the travelling wind introduced into the distribution chamber can be distributed into a multiplicity of first and second jet ports and can be blown from a wide range of the inner surface of the chin cover portion. In addition, a wearer's breath is guided rearward by the air blown from the first jet ports, and the inside surface of the shield plate is cleaned by the air blown from the second jet ports. With these arrangements, the breath staying inside the shield plate can be eliminated to prevent a blur from occurring to the inner surface of the shield plate.

In addition to the above-described structure, with the provision that a single common valve body for simultaneously opening and closing the aforesaid plurality of jet ports is housed in the distribution chamber, an operating rod is connected to the valve body and has one end projected externally of the cap body through a slot extending in the operating direction of the valve body, and an operating knob for always covering said slot is provided on the projected end of said rod, it is ensured that the opening and closing of the jet ports can be effected readily and promptly, and the number of parts can be reduced and therefore the construction can be made simple and provided at less cost. Furthermore, since the valve body is housed in the distribution chamber and the slot through which the operating rod extends is always covered by the operating knob, a good external appearance of the cap body can be secured.

The above and other objects, features and advantages of the present invention will be apparent from the description of preferred embodiments which will be described in detail in connection with the accompanying drawings.

BRIEF DESCRIPTION OF THE DRAWINGS

The drawings show one embodiment of the present invention, in which.

DESCRIPTION OF PREFERRED EMBODIMENT

Figure 1:
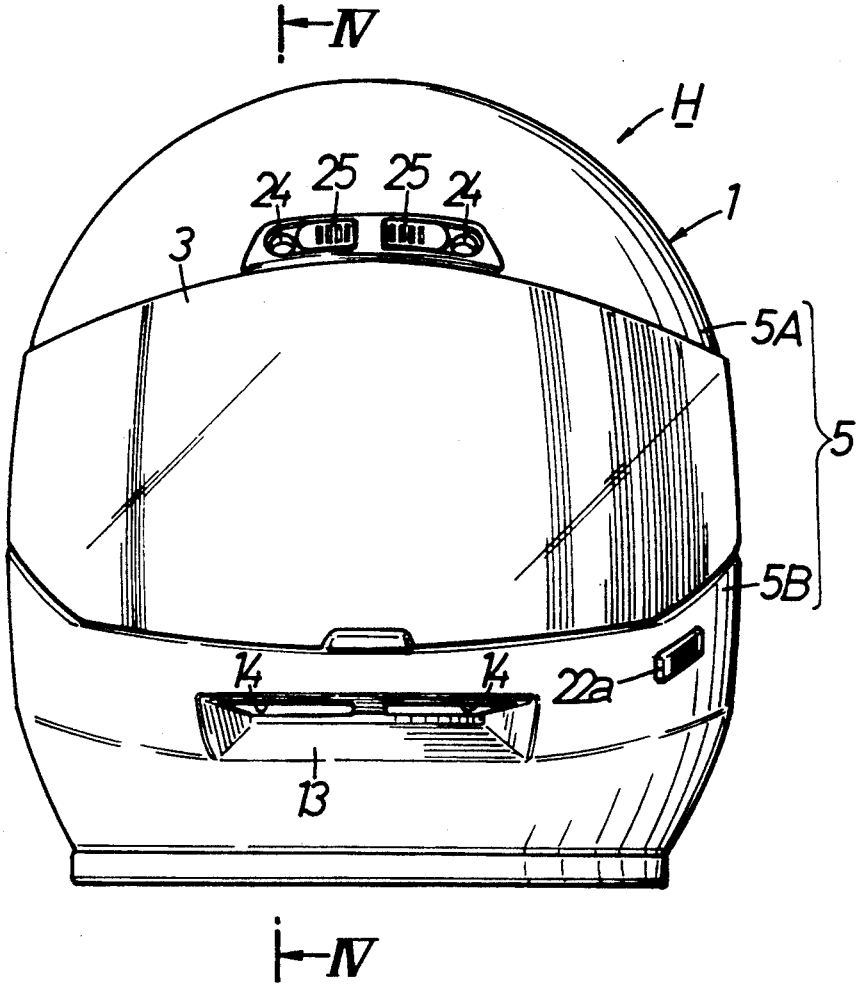
FIG. 1 is a front view of a helmet according to the present invention.

One embodiment of the present invention will be described hereinafter with reference to the drawings. Referring first to FIGS. 1 to 5, a full-face helmet is indicated at H which is principally worn by an operator for a motorcycle or a racing car. More accurately, a cap body 1 has a window opening 2 defined in the front wall thereof and further has a chin cover portion 1*a* directly below the opening 2. A light-pervious or transparent shield plate 3 is mounted at its opposite ends to the cap body 1 by means of pivots 4, 4 so that the window opening 2 can be opened and closed by upward and downward movements of the shield plate 3.

The cap body 1 is composed of a shell 5, a buffer liner 6 made of foamed polystyrene set inside the shell 5, a ceiling pad 7 made of relatively thick urethane foam adhered to the ceiling surface of the buffer liner 6, and a sweat proof cushion 8 adhered to the inner peripheral surface of the buffer liner 6 except its ceiling surface and the chin cover portion 1*a*.

The shell 5 is divided into an upper shell portion 5A and a lower shell portion 5B at a level of the chin cover portion 1*a*. Both the portions 5A and 5B are superposed while the lower shell portion 5B is positioned externally and are connected with each other at a few positions tbereof by means of rivets 9. The upper shell portion 5A is molded from thermosetting resin such as fiber-reinforced polyester, and the lower shell portion 5B is made by injection folding from thermoplastic resin such as ABS. If the shell 5 is divided into upper and lower portions as described above, even when the shell 5 takes a shape having its lower opening portion converged or narrowed, molding of the lower portion of the shell 5 can be accomplished easily.

The ceiling pad 7 is divided into a plurality of sections so as to define longitudinally extending vent grooves 10 inside the cap body 1.

In the chin cover portion la is defined a laterally elongating distribution chamber 12 by three members, i.e., the upper shell portion 5A, the lower portion 5B and an edge rubber 11 adhered to the peripheral edge portion of the window opening 2. Directly below the distribution chamber 12 a forwardly spreading air introducing port 13 and through-holes 14 for bringing the air introducing port 13 into communication with the distribution chamber 12 are provided in the lower shell portion 5B.

In FIG. 4, and FIGS. 6 to 12, a multiplicity of first jet ports 15 in communication with the distribution chamber 12 are formed in the upper shell portion 5A and the buffer liner 6 so as to open at the inner surface of the chin cover portion 1*a*. A multiplicity of second jet ports 16 are made in the edge rubber 11 for opening the distribution chamber 12 to the lower surface of the window opening 2. A single common valve body 17 is housed in the distribution chamber 12 for opening and closing the jet ports 15 and 16 which are arranged in first and second rows respectively.

The valve body 17 is composed of a plate-like valve portion 18 laterally slidably superposed to the rear surface of the distribution chamber 12 at which the first jet ports 15 are open, a multiplicity of tongue-like valve portions 19 project forwardly from the upper end of the plate-like valve portion 18 and slidably superposed to the upper surface of the distribution chamber 12, and a plurality of guide projections 20 project forwardly from the lower end of the plate-like valve portion 18 and placed in sliding contact with the front surface of the distribution chamber 12.

The plate-like valve portion 18 has provided therein valve holes 21 corresponding in number to the first jet ports 15 so that when the valve body 17 assumes an open position, the valve holes 21 are brought into registration with the first jet ports 15 whereas when the valve body 17 assumes a closed position, the first jet ports 15 are closed. The tongue-like valve portions 19 are provided correspondingly to and in the same number as that of the second jet ports 16 so that when the valve body 17 assumes the open position, the second jet ports 16 are opened whereas when the valve body 17 assumes the closed position, the second jet ports 16 are closed.

One end of an operating rod 22 is connected, in the distribution chamber 12, to one end of the valve body 17. The other end of the operating rod 22 is bent outwardly so as to penetrate through a slot 23 made in the lower shell portion 5B. The penetrating end of the operating rod 22 is provided at its extremity with a knob 22*a* of a size enough to always cover the slot 23.

The slot 23 is formed so as to allow lateral movement of the operating rod 22 and define the limit of movement thereof. With this, the limit of rightward movement of the operating rod 22 and the limit of leftward movement thereof determine the open position and the closed position of the valve body 17, respectively.

Turning again to FIGS. 1 and 4, the cap body 1 is formed at its front wall with a pair of left and right air introducing holes 24, 24 located directly above the window opening 2 and adapted to communicate the interior of the cap body 1 with the exterior. Slide valves 25, 25 capable of opening and closing these holes 24, 24 are provided on the shell 5.

Figure 2:
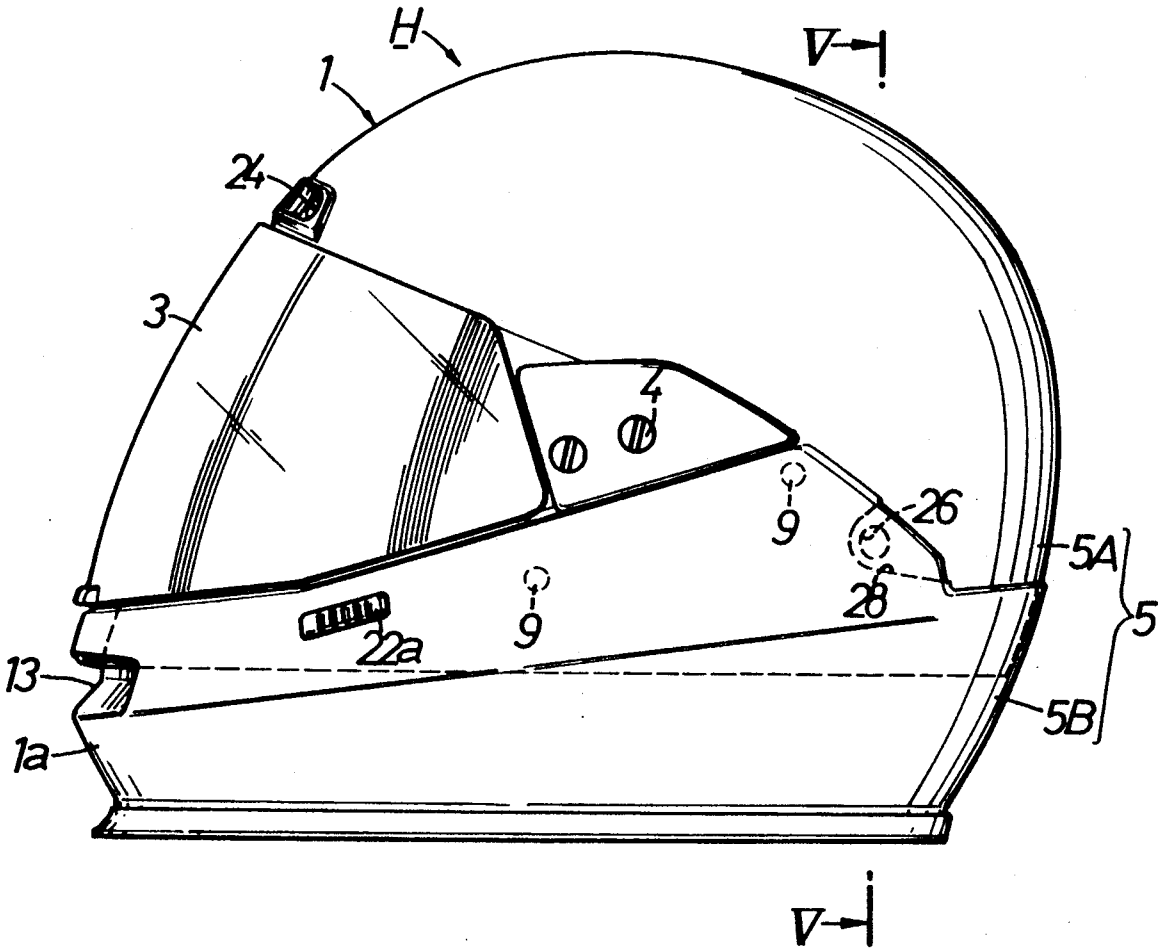
FIG. 2 is a side view thereof.
Figure 3:
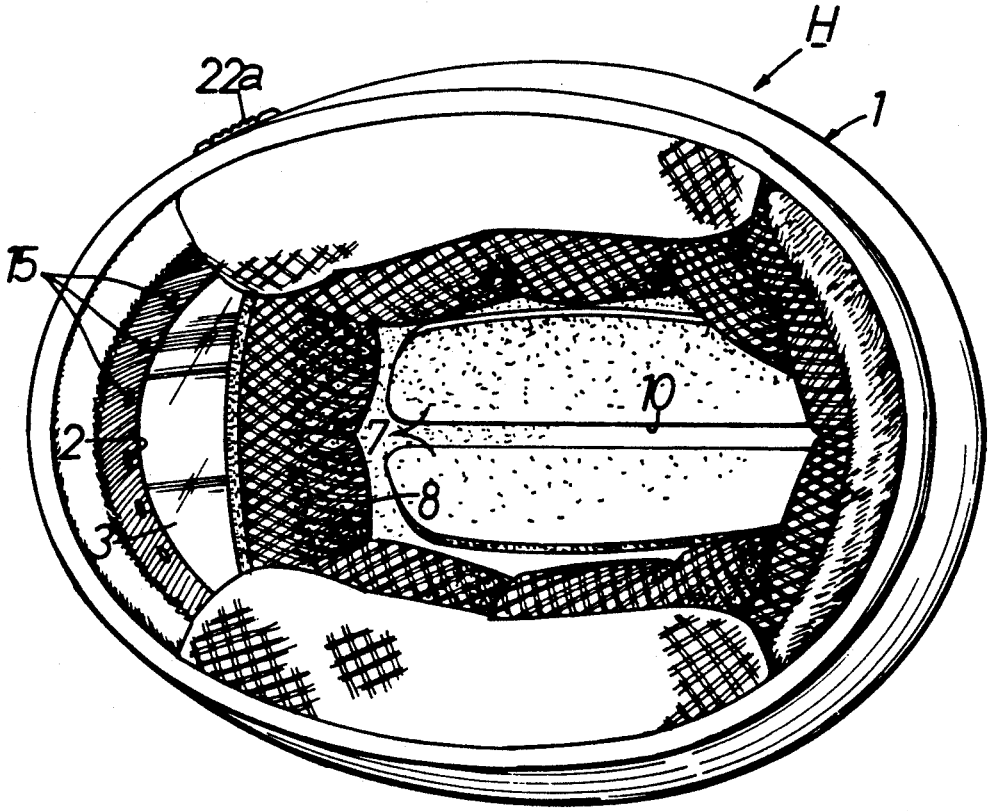
FIG. 3 is a bottom view thereof.
Figure 5:
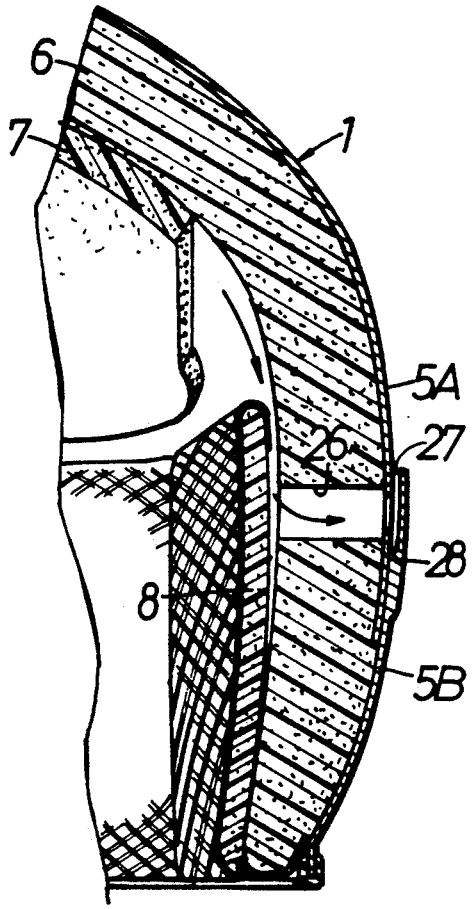
FIG. 5 is a sectional view taken on line V—V of FIG. 2.
Figure 6:
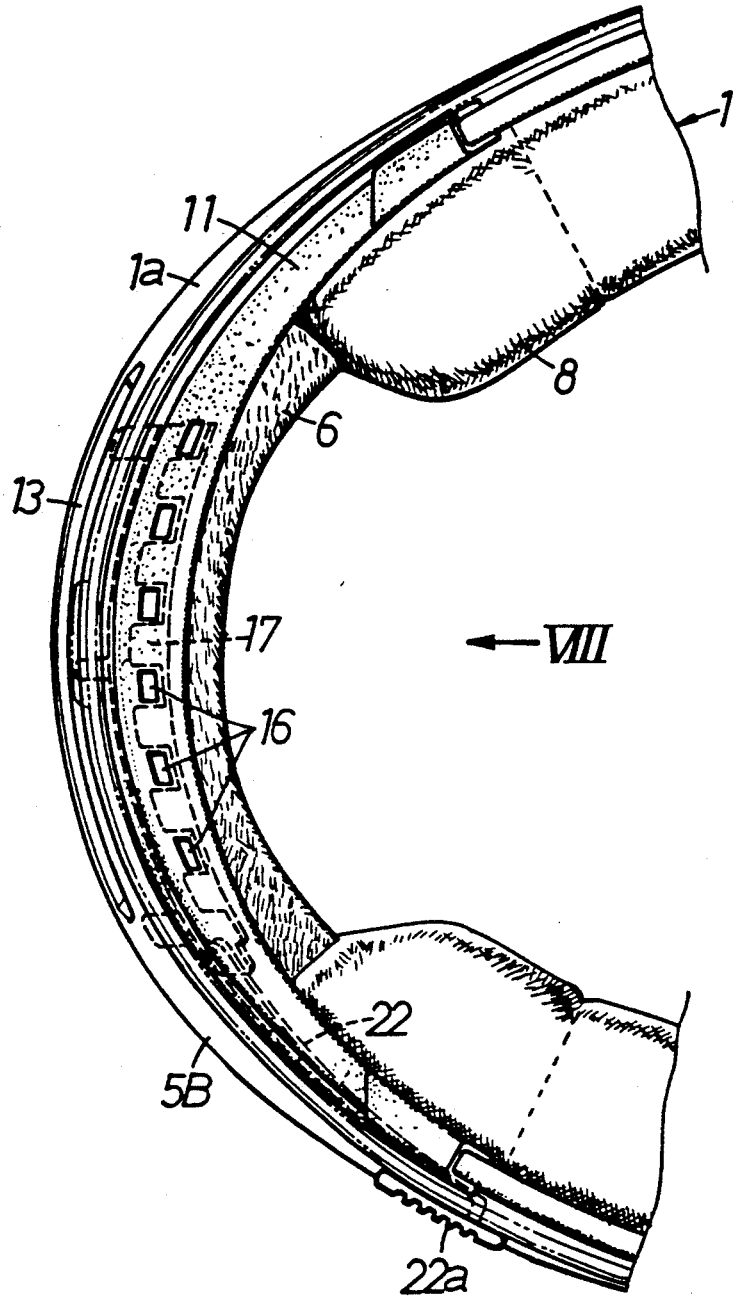
FIGS. 6 and 7 are sectional views taken on lines VI—VI and VII—VII respectively, of FIG. 4.
Figure 7:
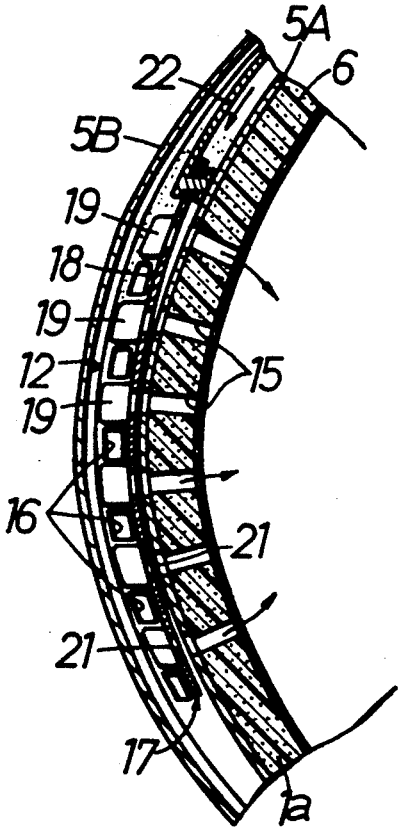
Figure 8:
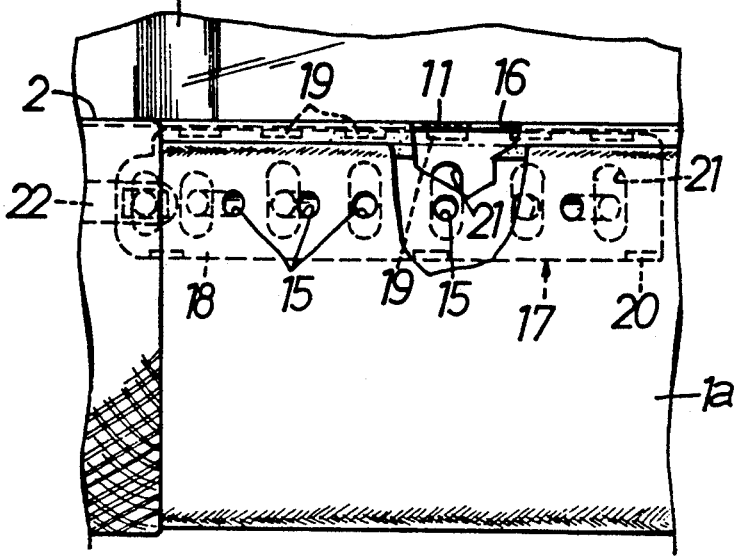
FIG. 8 is a view seen from the arrow VIII of FIG. 6.
Figure 9:
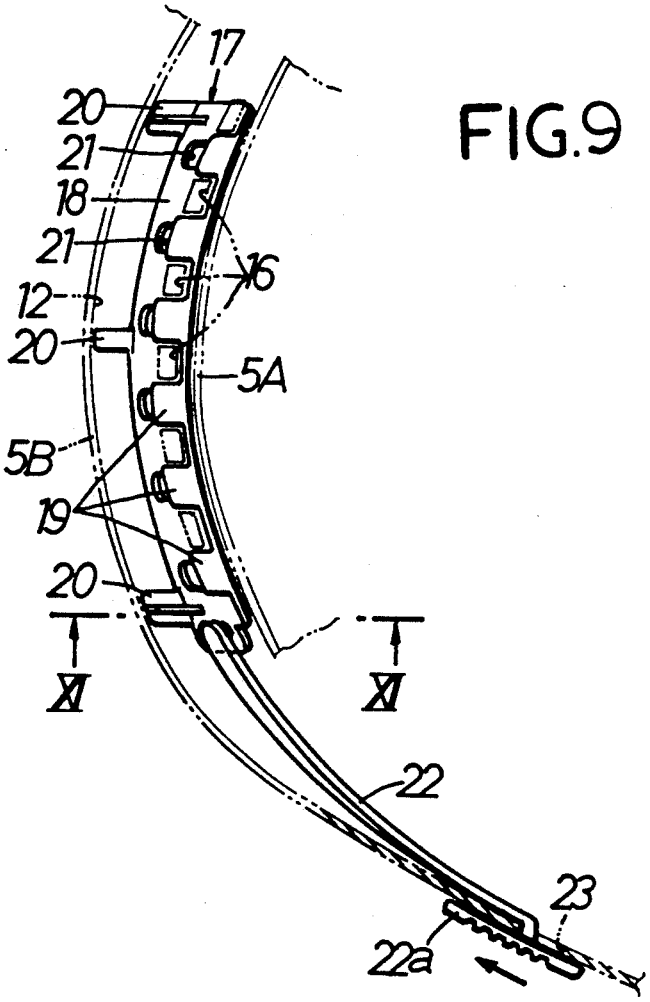
FIG. 9 is a plan view of a valve body and its operating rod.
Figure 10:
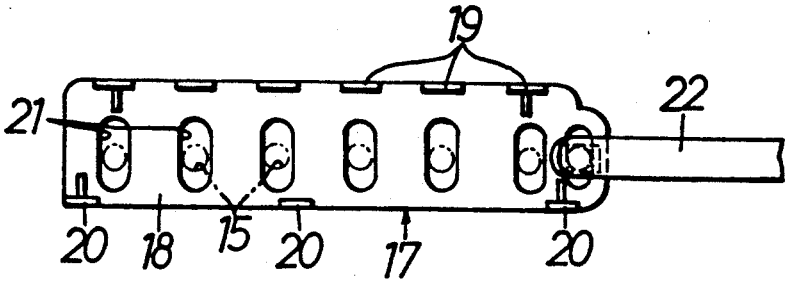
FIG. 10 is a front view thereof.
Figure 11:
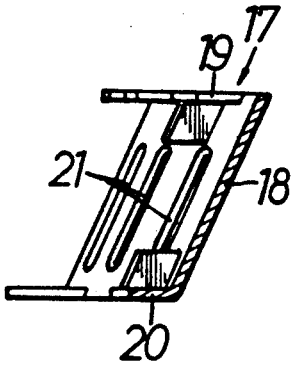
FIG. 11 is a sectional view taken on line XI—XI of FIG. 9.
Figure 12:
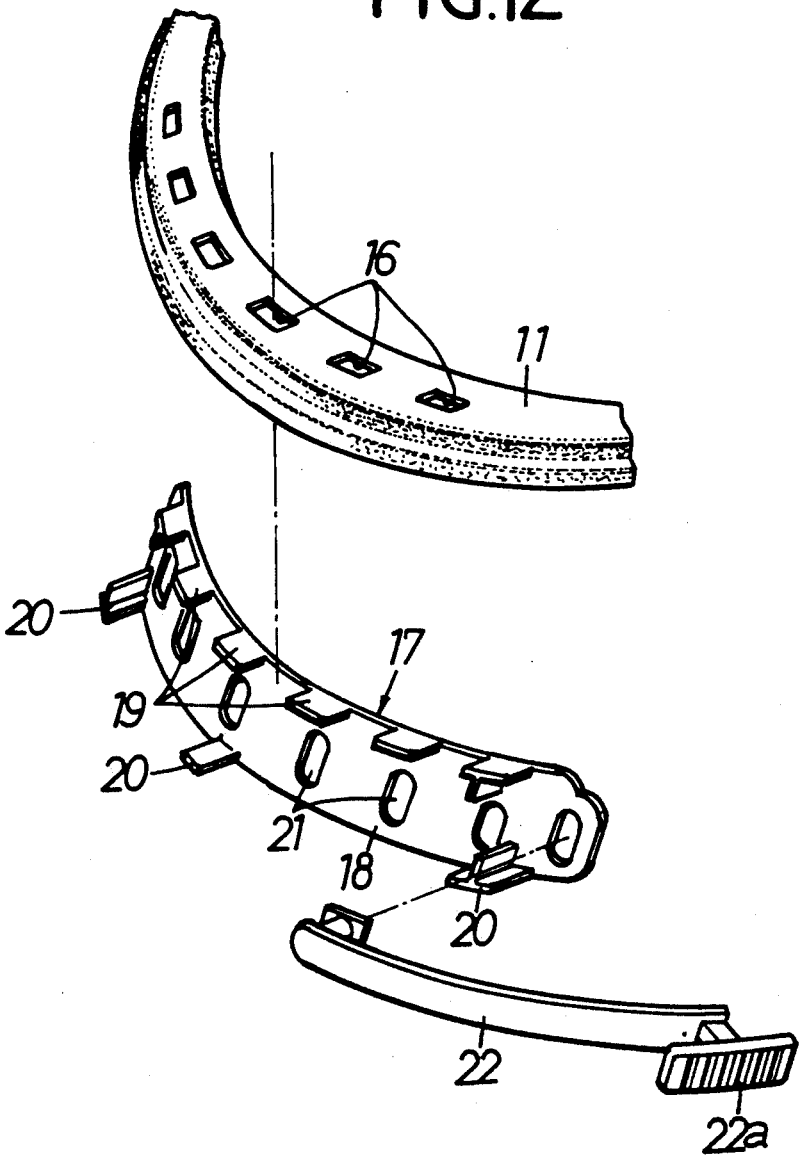
FIG. 12 is an exploded perspective view showing essential parts.

The cap body 1 is provided at its left and right walls with discharge ports 26, 26 adapted to provide a communication between the outside and inside of the body 1. These discharge ports 26, 26 have outer ends opened at the outer surface of the upper shell portion 5A, as shown in FIGS. 2 and 5, and the lower shell portion 5B is formed so as to cover the said outer open ends with a vent gap 27 being provided therebetween.

The vent gap 27 is opened upwardly and rearwardly, and the lower portion thereof is closed by a shoulder 28 of the lower shell portion 5B. The shoulder 28 is rearwardly downwardly inclined. With this, it is possible to prevent entry of rain into the discharge ports 26 and to ensure drainage from the vent gap 27.

Figure 4:
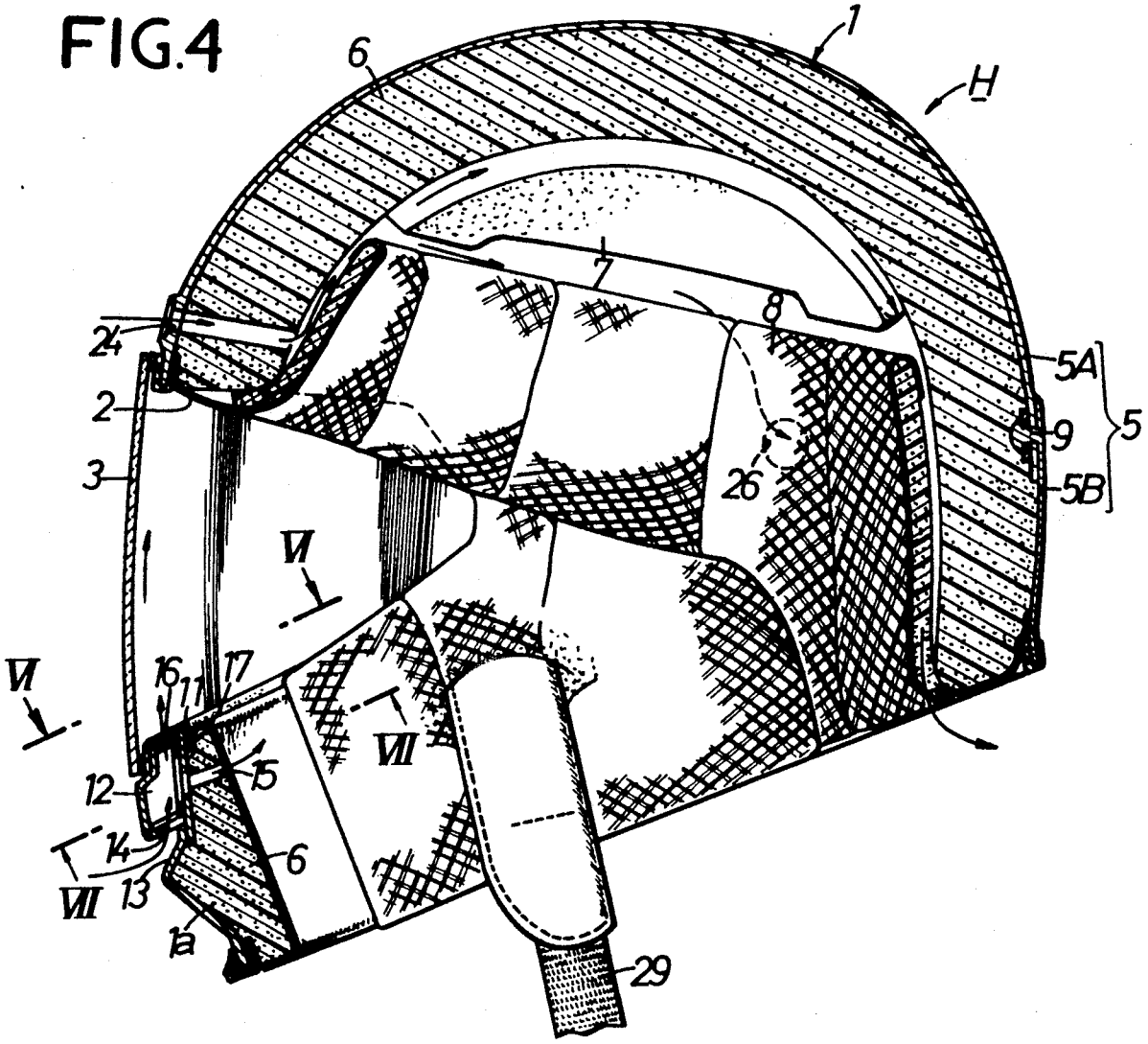
FIG. 4 is a sectional view taken on line IV—IV of FIG. 1.

In FIG. 4, reference numeral 29 designates a chin belt secured to the inner surface of the upper shell portion 5A by means of rivets not shown.

Next, the operation of the above-described embodiment will be described.

For example, if an operator of a motorcycle wears a helmet according to the present invention, travelling wind blows against the front surface of the helmet H as the vehicle travels.

Assume no that the valve body 17 is set to the open position, the inwardly spread air introducing port 13 receives a large quantity of travelling wind and then guides it into the distribution chamber 12 through the through-hole 14. Therefore, the travelling wind is blown over a wide range into the chin cover portion 1*a* through the multiplicity of the first and second jet ports 15 and 16.

At that time, air blown out of the first ports 15 flows toward the tip of the nose and the mouth of the operator to guide the operator's breath towards the rear. Then the air along with the breath passes through the sweat proof cushion 8 and ventilates the interior of the cap body 1, after which the air flows out of the discharge port 26 and/or of the lower end opening of the cap body 1. Particularly, negative pressure is being generated at the outward opening of the discharge port 26 by travelling wind flowing along the outer surface of the cap body 1, and therefore, the air discharging action through the hole 26 is protected.

On the other hand, air blown out of the second ports 16 rises upward along the inner surface of the shield plate 3. As the result, cooperating with the guided flow of the operator's breath rearwardly by the air blown from the first jet ports 15 as previously mentioned, it is assured that the breath does not stay inside the shield plate 3 and occurrence of a blur on the inner surface of the shield plate 3 can be prevented.

The air which bas ascended along the inner surface of the shield plate 3 flows through the sweat proof cushion 8 or passes through the vent grooves 10 while ventilating the interior of the cap body 1, and the air flows out of the discharge holes 26 and/or of the lower opening of the cap body 1.

Incidentally, even if, during travelling of a vehicle in the rain, rain water enters the air introducing port 13, it can hardly reach the through-hole 14 positioned above the introducing port 13. And even if rain should pass through the through-hole 14 because of heavy rainfall, energy of the rain can be effectively attenuated in the distribution chamber 12 having a relatively large volume, and therefore, the cap body 1 is not inundated with water. The rain attenuated in the distribution chamber 12 flows from the through-hole 14 to the outside.

Next, if the operating rod 22 is moved leftward by operating the knob **22*a* by the finger tip to switch the valve body 17 to the closed position, the first jet ports 15 and the second jet ports 16 are simultaneously closed by the plate-like valve portion 18 and the tongue-like valve portions 19 respectively, and therefore, supply of travelling wind from the distribution chamber 12 into the cap body 1 stops promptly and positively. Since the slot 23 of the shell 5 through which the operating rod 22 extends is always covered with the knob 22*a*, entry of air into the slot 23** is prevented, and a good external appearance is assured.

When the slide valves 25. 25 are opened, the travelling wind blowing against the front surface of the cap body 1 flows also into the air introducing holes 24, 24, further ventilating the interior of the cap body 1 through the holes.

In the helmet H as described above, the distribution chamber 12 is defined by the upper shell portion 5A, the lower shell portion 58, which are superposed and connected with one another, and the edge rubber 11 and moreover the air introducing port 13 is provided in the lower shell portion 5B. Therefore, the distribution chamber 12 and the air introducing port 13 can be formed very easily, and even if the distribution chamber 12 and the air introducing port 13 are formed large in order to effectively introduce the travelling wind, the strength of the shell 5 is not significantly impaired. Particularly, in the case where the lower shell portion 5B is injection molded, formation of the distribution chamber 12 and the air introducing port 13 can be carried out very easily.

What is claimed is:

1. A helmet comprising a cap body provided with a chin cover portion extending to define a lower edge of a window opening on a front surface of the body and a shield plate mounted on said cap body for closing the window opening, wherein the cap body has a shell which is divided at a position of the chin cover portion into an upper shell portion and a lower shell portion, said upper and lower shell portions being superposed and connected with each other with the lower shell portion positioned on an outer side of said upper shell, a distribution chamber defined between said upper shell portion and said lower shell portion at said chin cover portion, a plurality of jet ports providing fluid communication between said distribution chamber and an interior of said cap body, and an air introducing port in said lower shell portion, said air introducing port opening through a front surface of said chin cover portion and providing fluid communication with said distribution chamber.

2. A helmet comprising:

a cap body provided with a chin cover portion extending to define a lower edge of a window opening on a front surface of the body and a shield plate mounted on said cap body for closing the window opening;

a distribution chamber laterally extending in said chin cover portion;

an air introducing port communicating with said distribution chamber and opening to a front surface of said chin cover portion;

a plurality of first jet ports extending from a rear portion of said distribution chamber and opening to a rear surface of said chin cover portion;

a plurality of second jet ports extending from an upper portion of said distribution chamber and opening to a lower surface of the window opening; and said first and second jet ports being laterally arranged in a first and second row, respectively.

3. The helmet according to claim 1 wherein said air introducing port is formed to expand in a forward direction.

4. The helmet according to claim 1 wherein said air introducing port is located below the distribution chamber.

5. The helmet according to claim 1 wherein said upper shell portion is formed of thermosetting resin material, and said lower shell portion is formed of thermoplastic resin material.

6. The helmet according to claim 1 and further including: a single common valve body housed in the distribution chamber for simultaneously opening and closing said first and second jet ports, a slot provided in the cap body and extending in an operating direction of the valve body, and operating rod connected to said valve body and having one end projected externally of the cap body through the slot, and an operating knob mounted on said projected end of the rod so as to cover the slot at all times.

7. The helmet according to claim 1, further comprising a discharge port having an outside opening provided in said upper shell portion and covered by the lower shell portion with a vent gap formed between the opening and the lower shell portion.

8. The helmet according to claim 2 wherein said air introducing port is formed to expand in a forward direction.

9. The helmet according to claim 2 wherein said air introducing port is located below the distribution chamber.

10. The helmet according to claim 2 and further including: a single common valve body housed in the distribution chamber for simultaneously opening and closing said first and second jet ports, a slot provided in the cap body and extending in an operating direction of the valve body, an operating rod connected to said valve body and having one end projected externally of the cap body through the slot, and an operating knob mounted on said projected end of the rod so as to cover the slot at all times.

* * * * *